United States Patent [19]

Henderson et al.

[11] 4,354,480

[45] Oct. 19, 1982

[54] FIREPLACE HEATING UNIT

[76] Inventors: Louis L. Henderson, Rte. 1, Box 362 YY; Louis L. Henderson, Rte. 1, Box 362 ZZ, both of Grottoes, Va. 24441

[21] Appl. No.: 132,295

[22] Filed: Mar. 20, 1980

[51] Int. Cl.[3] ..... F24B 7/00

[52] U.S. Cl. ..... 126/123; 126/121; 126/131; 126/139

[58] Field of Search ..... 126/120, 121, 123, 131, 126/139, 61, 63, 66, 67

[56] References Cited

U.S. PATENT DOCUMENTS

| | | | |
|---|---|---|---|
| 2,642,859 | 6/1953 | Brown | 126/121 |
| 4,191,162 | 3/1980 | Simms | 126/123 |
| 4,206,743 | 6/1980 | Niemela | 126/61 |
| 4,240,403 | 12/1980 | Bader | 126/121 |
| 4,263,889 | 4/1981 | Martenson | 126/123 |

FOREIGN PATENT DOCUMENTS

| | | | |
|---|---|---|---|
| 156626 | 5/1954 | Australia | 126/121 |

*Primary Examiner*—Samuel Scott

*Assistant Examiner*—Lee E. Barrett

*Attorney, Agent, or Firm*—B. P. Fishburne, Jr.

[57] ABSTRACT

An efficient heating unit for ready installation in any standard fireplace includes a refractory lined fire box contained within an outer shell to form a heat exchanger between hot gaseous fuel combustion products and living space air entering the jacket space between the walls of the fire box and the outer shell in a continuous convection cycle. Heated air re-enters the living space through a grill above the fire box and fire box flue maze. The flue maze or manifold forms a radiator of great surface area which projects into the living space immediately below the heated air grill and the maze is vented into the chimney by two non-adjustable and one adjustable vents which are sealed from the air passages of the heat exchanger. Lockable and adjustably vented doors at the front of the fire box are provided. A three piece face plate formed of thin metal having thermal contact with both the fire box and heat exchanger shell maximizes heat radiation into the living space.

2 Claims, 10 Drawing Figures

FIREPLACE HEATING UNIT

BACKGROUND OF THE INVENTION

In recent times, because of the world wide energy crisis, many proposals for fireplace stoves and heaters have been made. The following prior United States patents reflect some of these proposals which have at least a general relation to the present invention:

U.S. Pat. Nos. 3,880,141, 3,938,496, 3,987,778, 3,995,611, 4,036,205, 4,136,665, 4,141,336.

The present invention seeks to improve on the prior art in a number of respects resulting ultimately in increasing the amount of heat which can be recovered and utilized for living space heating from a given quantity of fuel. In attaining this broad objective, the heating unit according to the invention utilizes several important feature which coact to improve overall efficiency. The most important of these features is a unique maze or manifold chamber for hot combustion products receiving such products from a discharge passage at the top of the fire box and causing the combustion products to flow through tortuous exhaust passages leading ultimately to the flue or chimney after passing through one adjustable and two constantly open non-adjustable exhaust openings leading to the chimney or flue.

A second major feature of the invention is the provision of a heat exchanger passage or jacket surrounding the fire box of the heating unit and formed by an outer shell integrated with the inner fire box shell. Living space air enters the heat exchange passage or jacket space and flows constantly in heat exchange relationship to the hot combustion products simultaneously flowing in the exhaust maze which is isolated at all times from the air heat exchange passage. The heated air enters the living space through a grill covering the outlet end of the heat exchange passage or space.

Another very important novel feature of the invention is the utilization in the combustion products exchaust maze of a very large expanse of metal for heat transfer purposes and having a significant frontal portion of this maze with the fire box therebelow and the doors of the latter projecting into the living space from the fireplace void above the hearth. Direct radiation of large amounts of heat into the living space is thus achieved to supplement hot air flow through the grill. Further significant radiation is achieved through utilization of a three piece thin metal face plate at the front of the fireplace void in thermal contact with the fire box shell and air heat exchanger structure. This face plate also seals the fireplace void against receiving air from the living space around the margins of the heating unit to be lost up the chimney.

The construction of the unit is such that heat radiating from the fire box behind the face plate within the fireplace void cannot directly escape up the chimney but is utilized to further heat and flowing air in the heat exchange passage or jacket. All of these features contribute to maximizing the overall thermal efficiency of the invention in comparison to the known prior art.

Additional features and advantages of the invention will be set forth during the course of the following detailed description.

It should be mentioned that another important objective achieved in the invention is a strong and durable inwardly welded structure which is practical to manufacture and inexpensive compared to many prior art devices.

DETAILED DESCRIPTION

Figure 1:
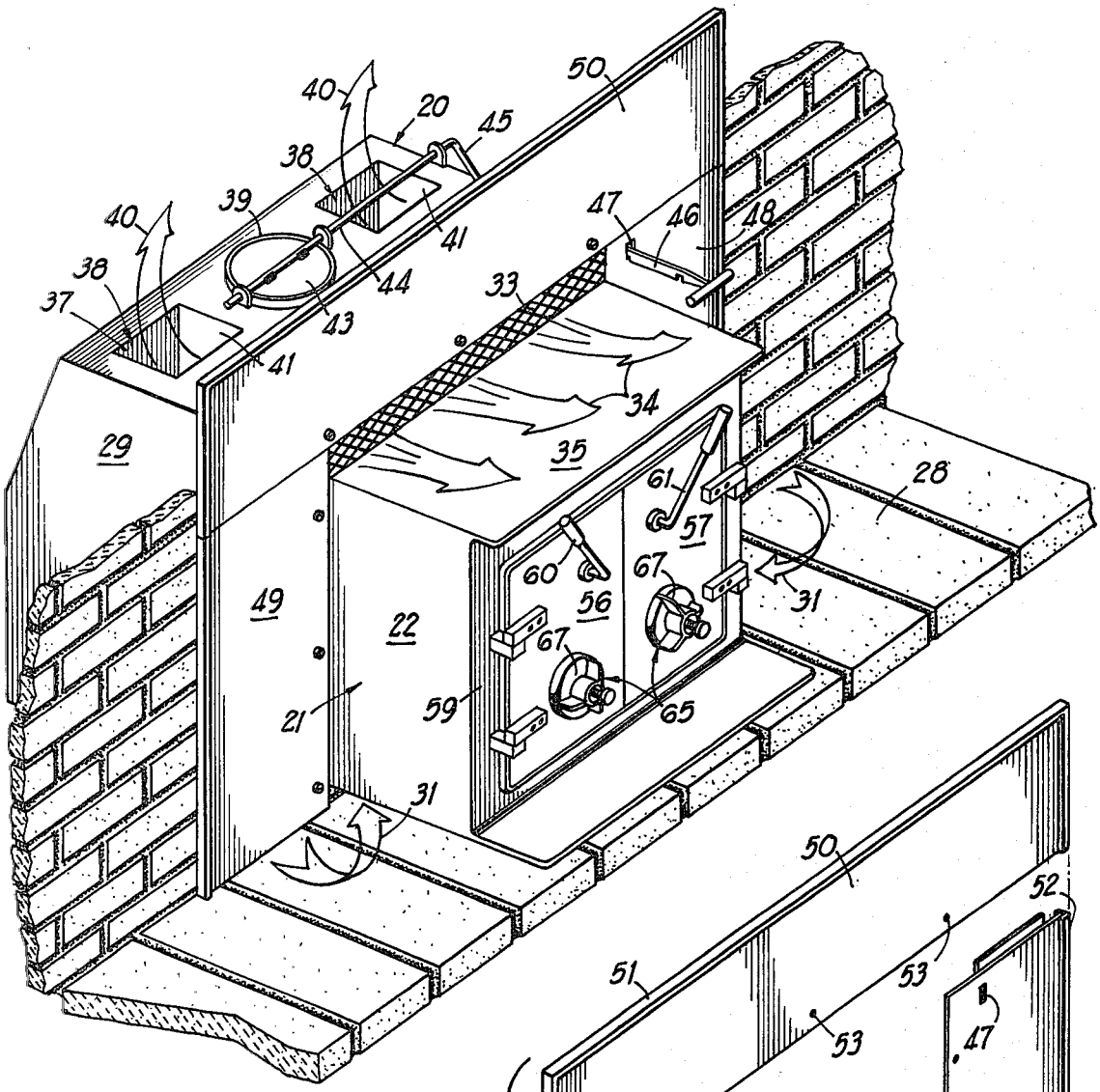
FIG. 1 is a perspective view of a heating unit according to the invention installed in a typical fireplace void.

Referring to the drawings in detail wherein like numerals designate like parts, a heating unit 20 according to the invention may be permanently or temporarily installed in a fireplace void as depicted in FIG. 1. The unit 20 may be sized and shaped to fit into the most common standard fireplace.

The heating unit comprises a fire box 21 defined by a fire box metal shell 22, as shown in the drawings, and the fire box is lined with suitable fire brick 23 on its floor and side and back walls. Angle iron retainers 24 welded to the fire box shell 22 position and retain the vertical fire bricks 23 while the floor or horizontal fire bricks are retained by the side wall fire bricks and by the rear wall fire bricks and a shallow front wall portion 25 of the fire box shell.

The fire box extends for the full front-to-back depth of the heating unit and substantially across it and the fire box shell includes a top wall 26 parallel to the floor of the shell. The top wall 26 also forms the horizontal floor of a very important combustion products maze or manifold 27 constructed of a very large or expansive metal surface area for the sake of heat transfer to living space air and direct thermal radiation into the living space forwardly of the fireplace. As best shown in FIG. 1, approximately one-third of the heating unit and fire box projects into the living space from the fireplace void and above the fireplace hearth 28. The remaining two-thirds of the unit is totally within the fireplace void.

Figure 5:
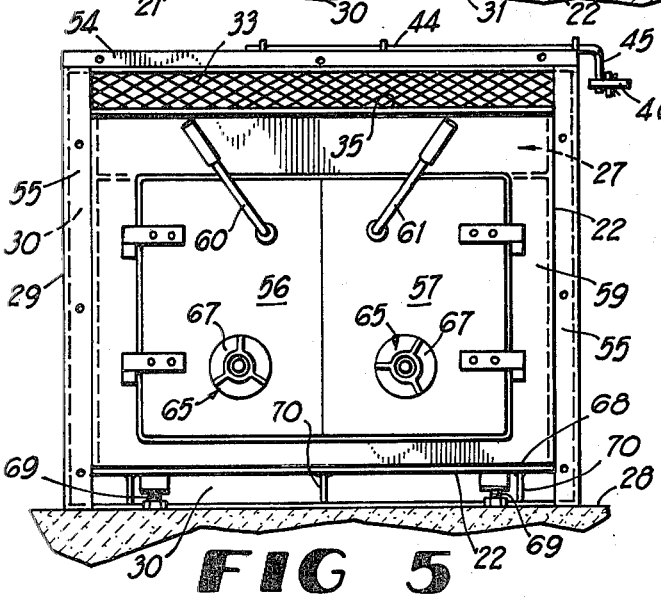
FIG. 5 is a front elevation of the heating unit.

An outer meal shell 29 of the heating unit essentially surrounds the two-thirds portion of the fire box 21 which is located in the fireplace void and thereby forms around the fire box a heat exchange jacket or passageway 30 which is very important to the overall operation of the unit. The bottom of the heat exchange jacket 30 is frontally open, as clearly shown in FIG. 5 and also in FIGS. 6 and 7, to receive living space air near floor level flowing in the direction of arrow 31 into the heat exchange jacket. Such air receives heat directly from burning fuel, such as wood, in the fire box 21 by conduction through the inner fire box shell 22 and this heat cannot escape up the chimney as will be further explained. Instead, it is transferred to the air from the living space flowing by convection through the heat exchange jacket 30 in the direction of arrows 32.

At the top of the unit and above the combustion products maze 27, the heated air returns horizontally to the living space through a grill 33 immediately above the portion of the heating unit which is projecting from the fireplace void into the room or living space, as indicated by the arrow 34.

Figure 7A:
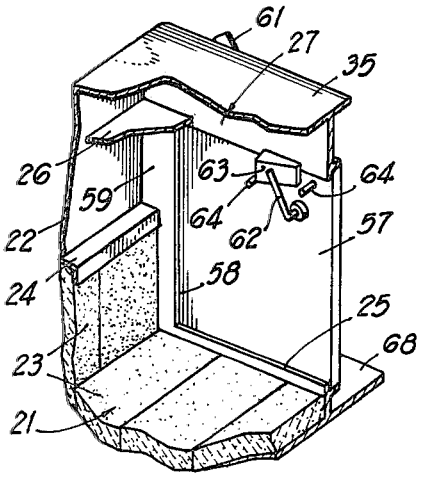
FIG. 7A is a fragmentary perspective view showing fire box door locking means.
Figure 3:
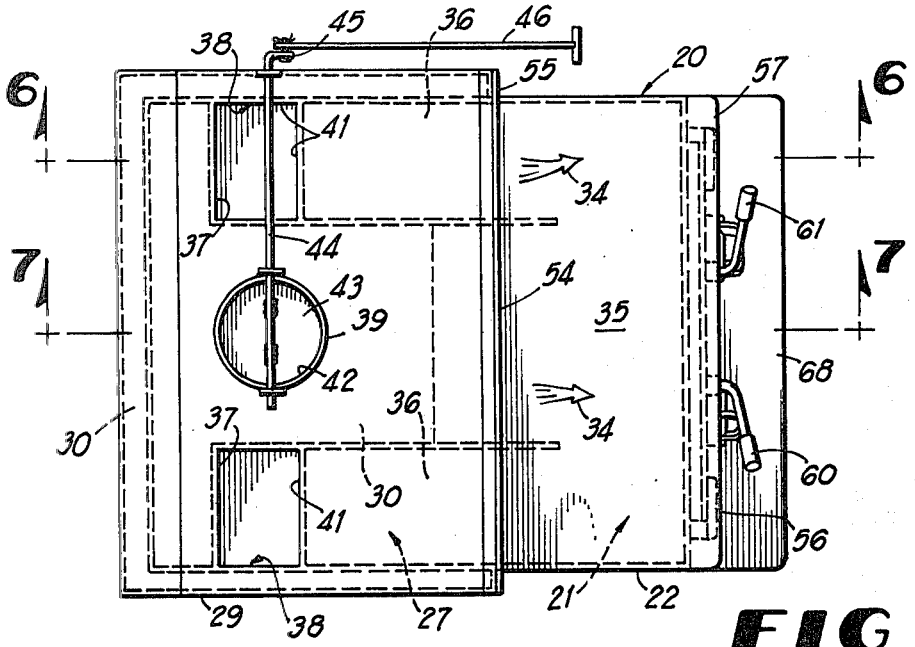
FIG. 3 is a plan view of the heating unit.
Figure 4:
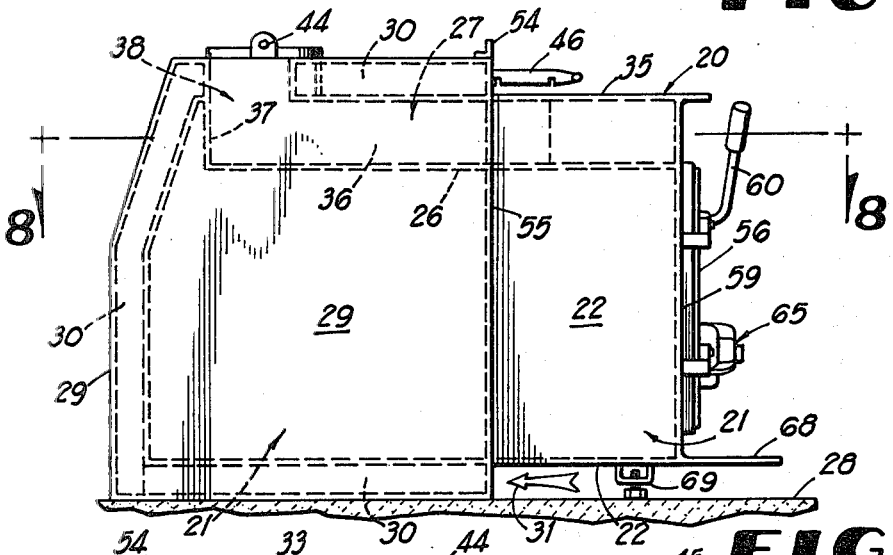
FIG. 4 is a side elevation thereof.
Figure 6:
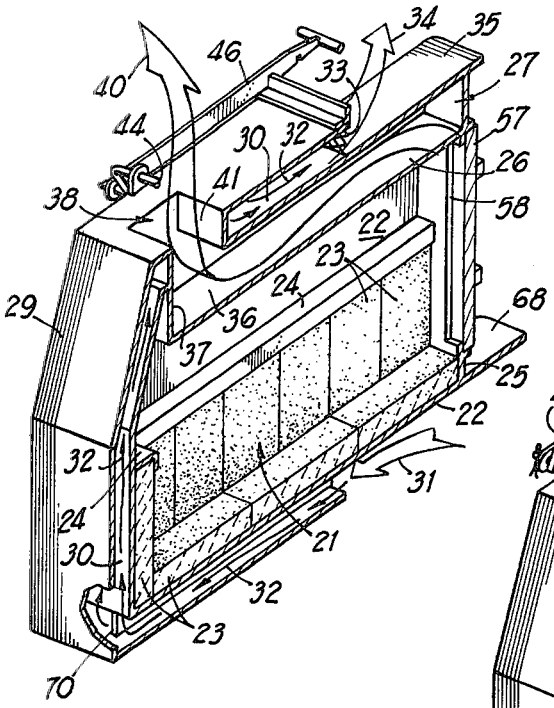
FIG. 6 is a perspective view in vertical section taken on line 6—6 of FIG. 3.
Figure 7:
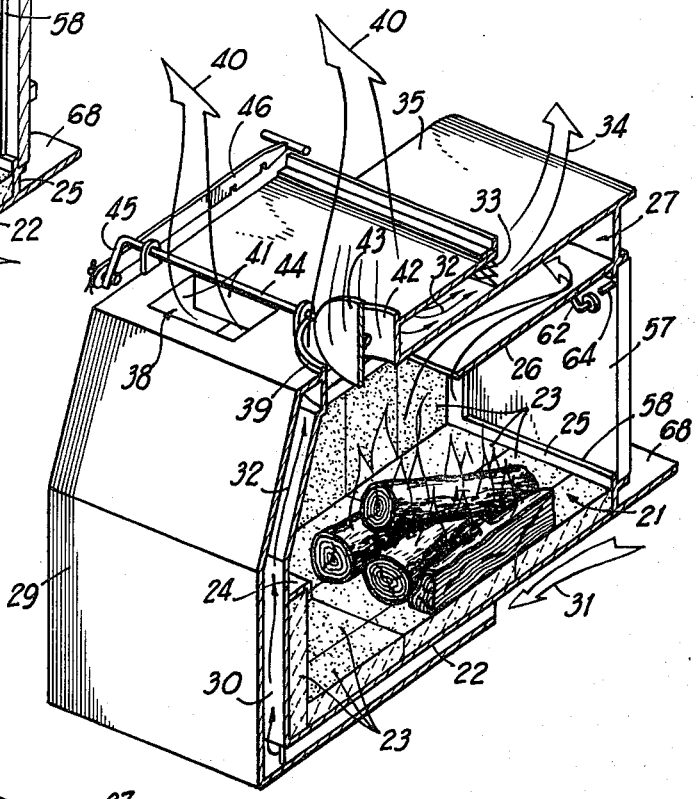
FIG. 7 is a similar view taken on line 7—7 of FIG. 3.
Figure 8:
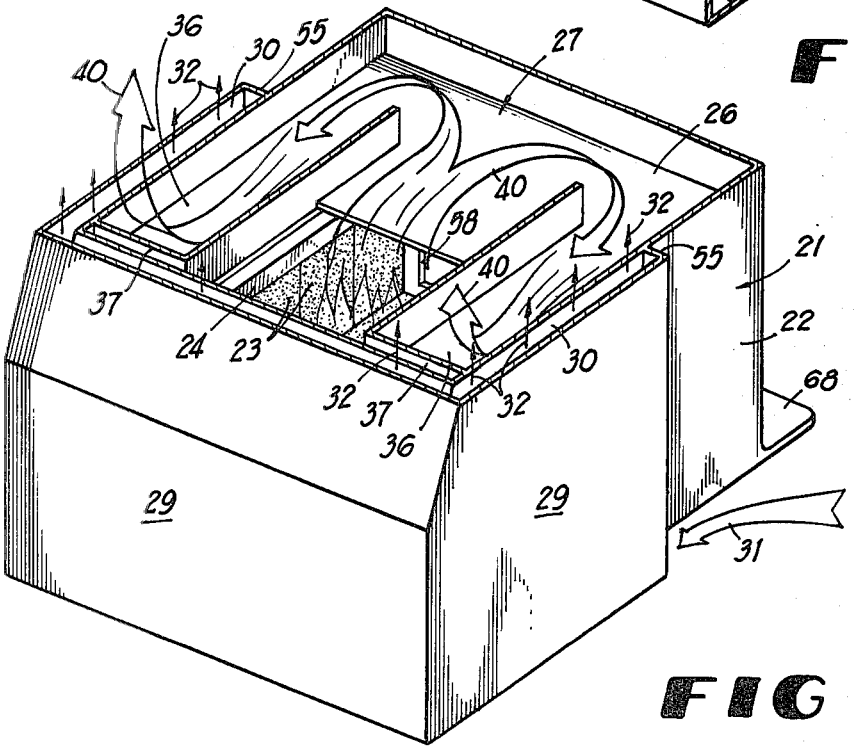
FIG. 8 is a perspective view in horizontal section taken on line 8—8 of FIG. 4.

A unique feature of the invention is that the heat exchange jacket 30 for air surrounding the fire box 21 is also in heat exchange relationship with the combustion products maze 27 at the top of the unit and this further substantially increases the amount of heat transferred to the flowing living space air. As shown in FIGS. 4, 6 and 7, the top horizontal portion of heat exchange jacket 30 is directly above the maze 27 and the top wall 35 of the maze also forms the floor of that portion of the jacket or passage 30 above the maze and rearwardly of the grill 33. The maze 27 for combustion gases also extends forwardly of the heat exchange jacket 30 and entirely across the width of the fire box 21 above the fire box top wall 26, as clearly shown in FIG. 8, The maze 27 also has spaced parallel branches 36 extending rearwardly to points near the back of the unit defined by rising walls 37.

The combustion products maze 27 is vented into the chimney through two non-adjustable vents 38 and a single adjustable vent 39 centered between the two vents 38, the flow paths of the chimney gas being indicated by the arrows 40. As best shown in FIGS. 6 and 7, the vents 38 and 39 are completely separated from the air jacket 30 by the ascending walls 37, 41 and 42 which define the respective vents 38 and 39.

Figure 2:
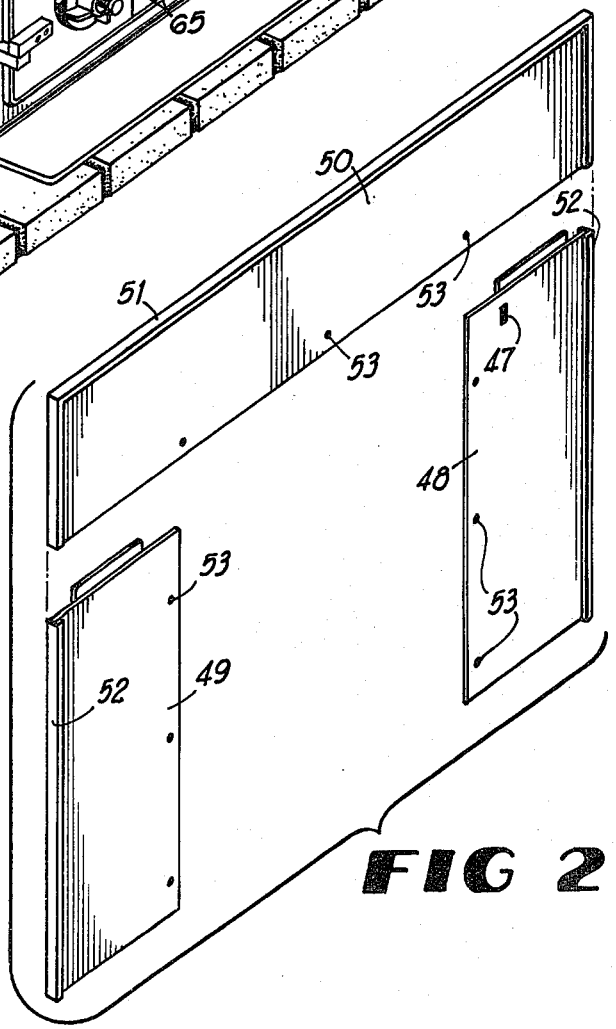
FIG. 2 is an exploded perspective view of a three place thin metal radiating and sealing face plate for the heating unit.

The adjustable vent 39 has a valve plate 43 secured to a rocker shaft 44 including a crank arm 45 pivotally connected to a notched front-to-rear push-pull handle 46 which is guided through and locked in a selected adjusted position by an opening 47 formed through one vertical section 48 of a three-part face plate, FIG. 2, having another vertical section 49 and an upper horizontal section 50.

The three-part face plate enhances the portability and ease of installation of the heating unit. The face plate sections are also formed of thin gage metal to promote the direct transfer of heat into the living space. The thin-walled sections of the face plate are stiffened by marginal flanges 51 and 52. Fastener openings 53 are provided in the face plate sections to allow their ready attachment to an angle bar 54 extending across the top of the unit above the air outlet grill 33 and to adjacent vertical walls 55 which define the front terminals of air jacket 30, see FIG. 8. The face plate, after installation in the manner shown in FIG. 1, prevents room air from entering the chimney around the margins of the heating unit and being lost up the chimney. It also provides an attractive facing.

The front portion of the heating unit projecting into the room space, FIG. 1, is equipped with hinged doors 56 and 57 to cover the large rectangular frontal opening 58 in the fire box forward vertical wall 59. The door 56 has a fixed handle 60 thereon for opening and closing, while the other door 57 has a swingable handle 61. The handle 61 at the inner side of the door 57, FIG. 7A, carries a transverse locking extension 62 movable into engagement with a wedge-like locking cam 63 on the adjacent front wall 59 of the fire box. The extension 62 is swingable between two limit stops 64 attached to door 57. When the two doors are closed and locked, the swinging edge of door 57 overlaps a flange on the corresponding edge of door 56 for sealing purposes.

Figure 5A:
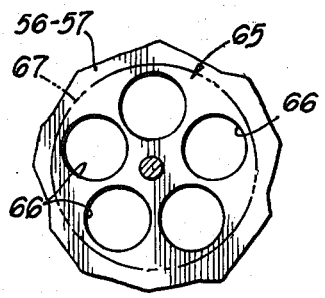
FIG. 5A is an enlarged front elevation of fire box door vent holes which coact with screw cap closure means, not shown.

Each door 56 and 57 possesses a door vent 65 having multiple vent holes 66 as shown in FIG. 5A. A screw cap closure 67 for each such vent regulates the degree of vent opening and thus the degree of air entering the fire box 21 to support combustion.

Immediately forwardly of the doors 56 and 57, the unit may have a horizontal clean-out extension plate 68, as illustrated. Adjustable support feet 69 are also provided below the projecting portion of the fire box 21 and these feet bear directly on the hearth 28. They promote the stability of the unit and compensate for any unevenness at the floor of the fireplace void. Ribs 70 are provided between the fire box floor 22 and the floor of the outer shell 29 for strength.

Operation

When the fire box 21 is fueled and the fuel is ignited, burning can be regulated by use of the vents 65 and also the adjustable chimney vent 39. A quite fine control can be achieved. Living space air continously enters the jacket space 30 at the bottom of the unit as shown by arrows 31 and flows rearwardly and upwardly and then forwardly through the grill 33 and back into the living space.

Simultaneously, combustion products are continuously flowing out of the top of the fire box, FIG. 7, and into the maze or manifold 27. In this maze, FIG. 8, the combustion products first flow forwardly from the center opening in the top of the fire box, then laterally outwardly toward the two sides of the unit, and then rearwardly in the side branches of the maze to the non-adjustable vents 38. Simultaneously, depending on the setting of the valve plate 43, some combustion products can flow directly into the flue or chimney through the center adjustable vent 39 which is aligned with the opening in the top of the fire box. The damper valve plate 43 is open or partly open as shown in FIG. 7 during initial igniting and kindling operations; when in the full heating mode as shown in FIG. 1, the valve plate 33 is closed for optimum efficiency of operation.

The air flowing in jacket 30 is in heat exchange relationship and separated from the combustion products flowing through the maze 27 and this effectively heats the air entering the living space from the grill 33. Additionally, the living space is heated by radiation from the forward fire box portion which projects into the living space and includes large metal surface areas. Above the fire box proper, much of the hot combustion products maze 27 with its large metal surface areas also projects into the living space and this adds greatly to radiation of heat. Finally, as previously discussed, the thin metal three piece face plate which is in contact with the fire box, the jacket 30 and the maze 27 supplements the radiation into the room or living space. The device is very efficient, compact and principally due to its large effective surface areas is thought to obtain the maximum amount of heat energy from a given quantity of fuel over the longest possible time of combustion. The device is in effect an efficient heat exchanger which features a unique interplay between fire box, air heat exchange jacket and combustion products manifold or maze with other supporting features.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A self-contained fireplace heating unit for placement in a fireplace void in communication with a chimney passage and adapted to deliver heated air into a living space in a convective process without forced draft means, said heating unit comprising a refractory lined firebox substantially filling the fireplace void and including a frontal portion projecting well forwardly of the void and into the living space to form a radiator means, frontal access door means on the forwardly projecting portion of the firebox and being vented, a jacket for the reception of living space air and the return of such air to the living space around the firebox portion within the fireplace void and including bottom frontally open section below the floor of the firebox and substantially across the same, a rear upright section at the back of the firebox extending from the floor to a level above the top of the firebox and substantially across the firebox transversely, and a top horizontal forwardly extending section leading forwardly from said rear section of the jacket and being frontally open substantially across the firebox and terminating at the front of the fireplace void to deliver heated air to the living space, the jacket further including vertical side sections extending for the full height of the firebox and from the front of the fireplace void to the rear of the firebox, the side sections being in communication with the other named sections of said jacket to form an integral comparatively narrow heat exchange jacket space substantially around all walls of the firebox within the void, and an integral combustion gas manifold maze for the heating unit in communication with the firebox and fireplace chimney passage and completely isolated from said jacket space, said manifold maze comprising a main large vertical entrance opening for rising combustion gases at the rear and top and lateral center of the firebox, a communicating main forward horizontal passage for combustion gases at the top of the main vertical passage and extending forwardly beyond the fireplace void to the front of said projecting portion of the firebox, two reverse horizontal side exit passages for combustion gases on opposite sides of the main passages and extending to the rear of the firebox and being constantly in communication with the chimney passage, an adjustable damper valve in said main large vertical entrance opening for rising combustion gases to selectively place such entrance opening in a desired degree of communication with the chimney passage or to block direct communication of such entrance opening with the chimney passage, and remote means to operate said damper valve from said living space.

2. A self-contained fireplace heating unit as defined in claim 1, and the horizontal floor of the combustion gas manifold maze defining the roof of the firebox and having the main large vertical entrance opening formed therethrough, and the horizontal floor of the top section of said jacket also forming the roof of said combustion gas manifold maze whereby the jacket and manifold maze are in compact stacked heat transfer relationship immediately above the top of the firebox and over substantially the entire horizontal area of the firebox.

* * * * *